US005718021A

United States Patent [19]

Tatum

[11] Patent Number: 5,718,021

[45] Date of Patent: Feb. 17, 1998

[54] SHOELACE TYING DEVICE

[76] Inventor: Richard G. Tatum, 48 Harness La., Sudbury, Mass. 01776-1502

[21] Appl. No.: 784,153

[22] Filed: Jan. 17, 1997

[51] Int. Cl.[6] ..... F16G 11/00

[52] U.S. Cl. ..... 24/712.2; 24/712.3; 24/712.6

[58] Field of Search ..... 24/712, 712.1, 24/712.2, 712.3, 712.6

[56] References Cited

U.S. PATENT DOCUMENTS

| | | | |
|---|---|---|---|
| 303,549 | 8/1884 | Snyder | 24/712.2 |
| 574,484 | 1/1897 | Johnson | 24/712.2 |
| 1,371,637 | 3/1921 | Meredith | 24/712.3 |
| 3,473,198 | 10/1969 | Meier | 24/712.3 |
| 4,553,293 | 11/1985 | Blum | 24/712.2 |
| 4,715,094 | 12/1987 | Herdman | 24/712.3 |
| 4,949,437 | 8/1990 | Anderson | 24/712.2 |
| 5,022,127 | 6/1991 | Ang | 24/712.3 |

*Primary Examiner*—Victor N. Sakran
*Attorney, Agent, or Firm*—Kriegsman & Kriegsman

[57] ABSTRACT

A device for tying a shoelace on a shoe, the shoelace having a first end and a second end. The device includes a base and a cover hingedly mounted on the base so as to be pivotable between an open position and a closed position. The base includes a top surface, a bottom surface and first and second holes which are sized and shaped so that the shoelace can be inserted therethrough. The cover includes a top surface, a bottom surface and first and second pins which are aligned so as to project into the first and second holes, respectively, when the cover is in the closed position. The cover also includes a locking tab which engages with a tip on the base to releasably lock the cover in the closed position. In use, with the first and second ends of the shoelace inserted through the first and second holes, respectively, with the base seated on top of and in direct contact with the shoe and with said cover pivoted in the closed position, said device prevents the shoelace from loosening within the shoe.

9 Claims, 4 Drawing Sheets

SHOELACE TYING DEVICE

BACKGROUND OF THE INVENTION

The present invention relates generally to tightening devices for shoes and more specifically to shoelace tying devices.

As used herein, the term "shoe" is intended to also include "sneakers" as well as other foot apparel.

It is well known for shoes to use a shoelace to fasten the shoe onto the foot of the wearer. Typically, the shoelace is laced at various positions on the shoe so as to enable the wearer to tighten the shoe to conform closely with the shape of the foot of the wearer.

Conventionally, the shoelace is manipulated in two general steps to help secure the shoe onto the foot of the wearer. In the first step, the free ends of the shoelaces are pulled tautly by the wearer which, in turn, causes the shoe to tighten around the foot of the wearer. In the second step, with the shoelace still being pulled tautly, the wearer locks or secures the desired tension of the shoelace by tying the shoelace into a bow-shaped knot.

However, there have been found to be numerous disadvantages in requiring the wearer to tie the shoelace into a bow-shaped knot in the second of the two aforementioned steps.

As a first drawback, the ability to tie the shoelace into a knot-shaped bow to secure the tension of the shoelace requires a relatively high level of manual dexterity. As a consequence, people who lack sufficient manual dexterity, such as children and arthritis sufferers, are unable to tie a shoelace into a bow-shaped knot.

As a second drawback, the conventional method of tying a shoelace into a bow-shaped knot to secure the tension of the shoelace is relatively insecure. Specifically, a shoelace formed into a bow-shaped knot will often become inadvertently untied. Once untied, the tension in the shoelace is released which will cause the shoe to loosen on the foot of the wearer. Having a shoelace become undone is extremely undesirable in some particular circumstances. For example, if the shoelace of a sneaker being worn by an athlete were to become untied during an athletic competition, the level of performance as well as the safety of the athlete would be significantly jeopardized. Furthermore, with the shoelace untied, portions of the shoelace will come in contact with the surface of the ground and therefore risks direct exposure to any water or dirt present on the surface of the ground.

SUMMARY OF THE INVENTION

It is an object of the present invention to provide a new and improved device for tying a shoelace on a shoe.

It is another object of the present invention to provide a device as described above which can be used to tie the shoelace of a shoe which requires a relatively low level of manual dexterity.

It is yet another object of the present invention to provide a device as described above which can be used for tying the shoelace of a shoe without having to form the shoelace into a knot.

It is still another object of the present invention to provide a device as described above which may be mass produced, has a minimal number of parts, and can be easily assembled.

Accordingly, a device for tying a shoelace on a shoe is provided, the shoelace having a first end and a second end, said device comprising a base having a top surface and a bottom surface, and a cover having a top surface and a bottom surface, said cover being hingedly mounted on said base so as to be pivotable between an open position and a closed position, wherein with a portion of the shoelace positioned between said base and said cover, with the base seated on top of and in direct contact with the shoe and with said cover pivoted in the closed position, said device prevents the shoelace from loosening within the shoe.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the present invention and, together with the description, serve to explain the principles of the invention. In the drawings wherein like reference numerals represent like parts.

DETAILED DESCRIPTION OF A PREFERRED EMBODIMENT

Figure 1A:
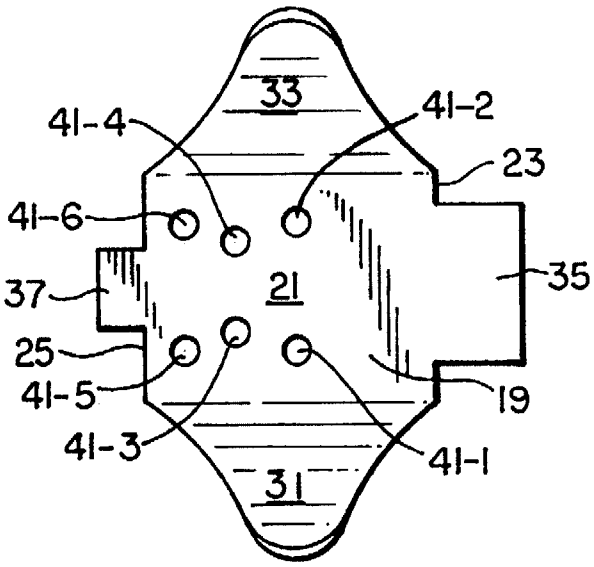
FIG. 1A is a plan view of the base shown in FIG. 1.
Figure 1:
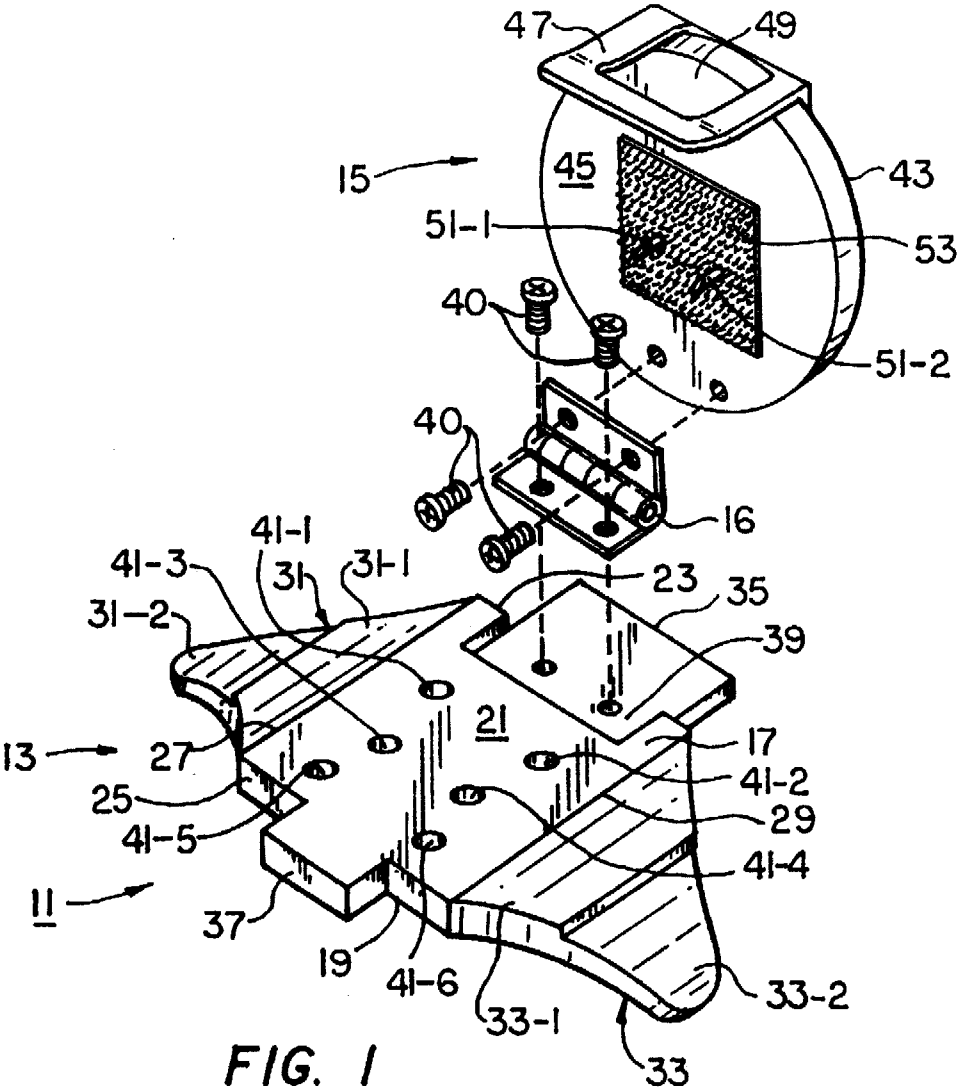
FIG. 1 is an exploded, perspective view of a device constructed according to the teachings of the present invention for tying a shoelace on a shoe.
Figure 2:
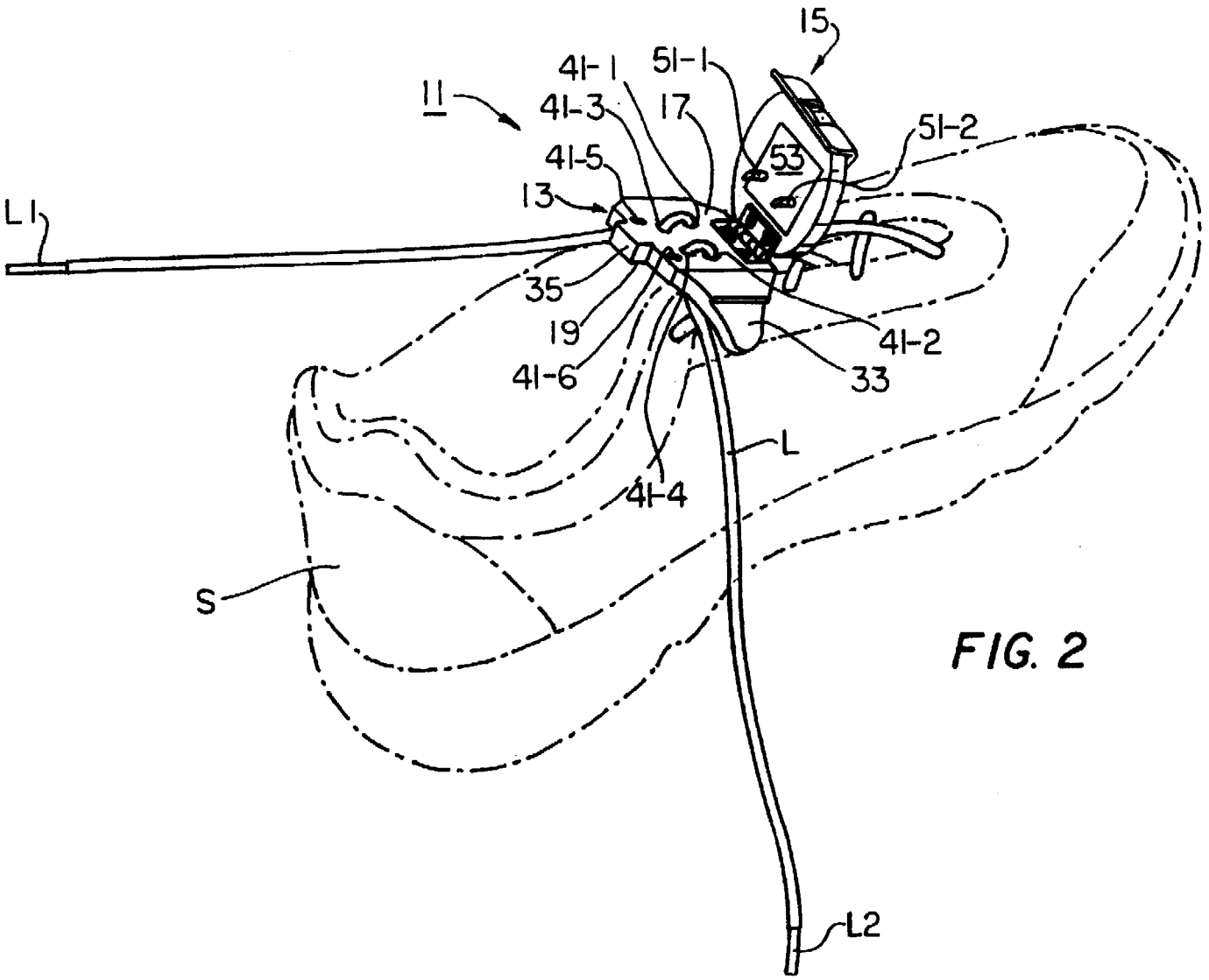
FIG. 2 is a perspective view of the device of FIG. 1 shown with the shoelace of a shoe, the shoe being shown in phantom, the device being shown in its open position with the shoelace inserted therethrough at one stage during use.
Figure 3:
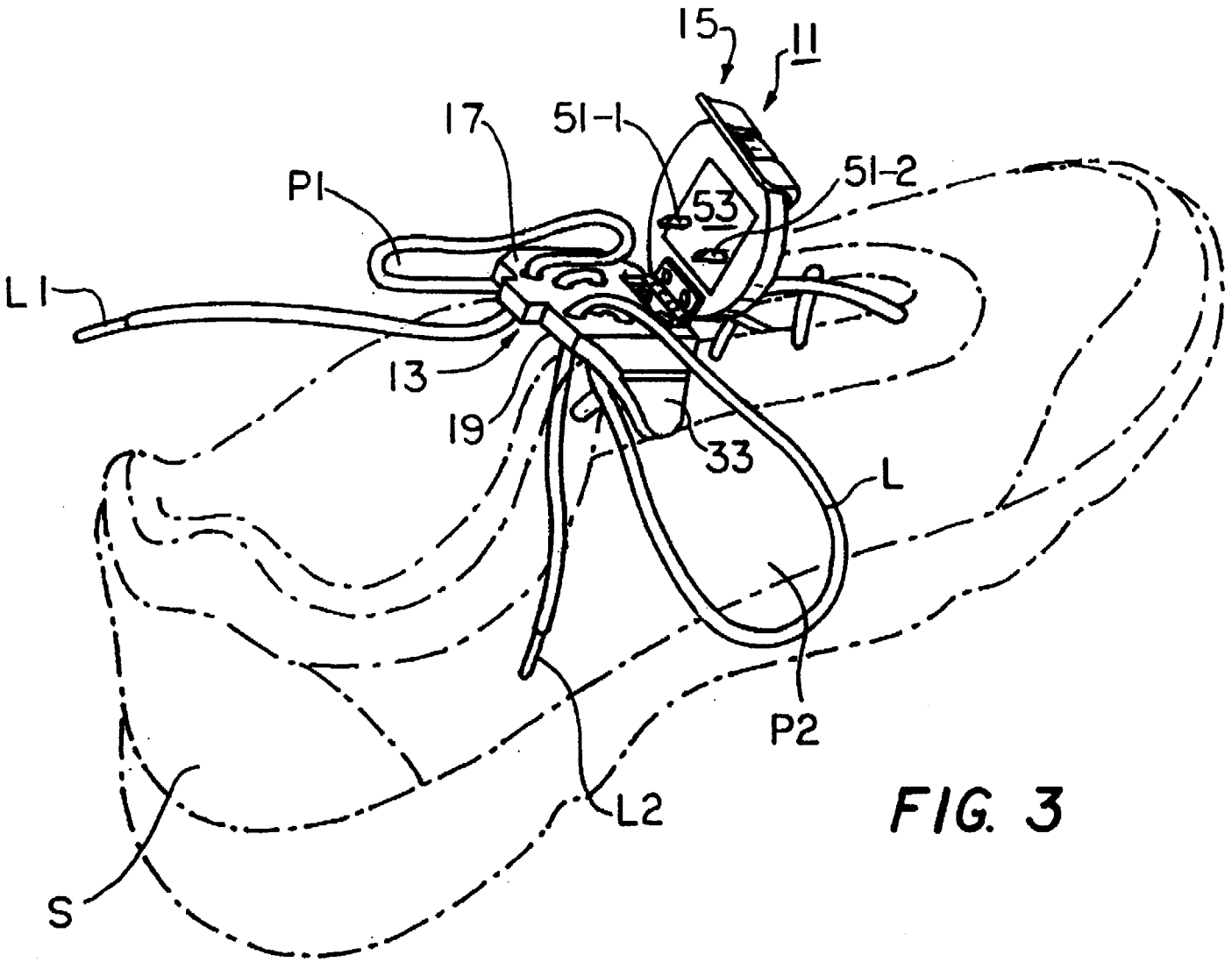
FIG. 3 is a perspective view of the device of FIG. 2, the device being shown in its open position with the shoelace inserted therethrough at another stage during use.

Referring now to the drawings and more particularly to FIG. 1, there is shown a device constructed according to the teachings of the present invention for tying a shoelace on a shoe, the device being represented generally by reference numeral 11. Those aspects of device 11 not pertinent to the present invention are neither described nor shown herein. In FIGS. 2 and 3, device 11 is shown with a shoelace L which is laced on a shoe S, shoe S being shown in phantom. Shoelace L has a first end L1 and a second end L2.

Figure 4:
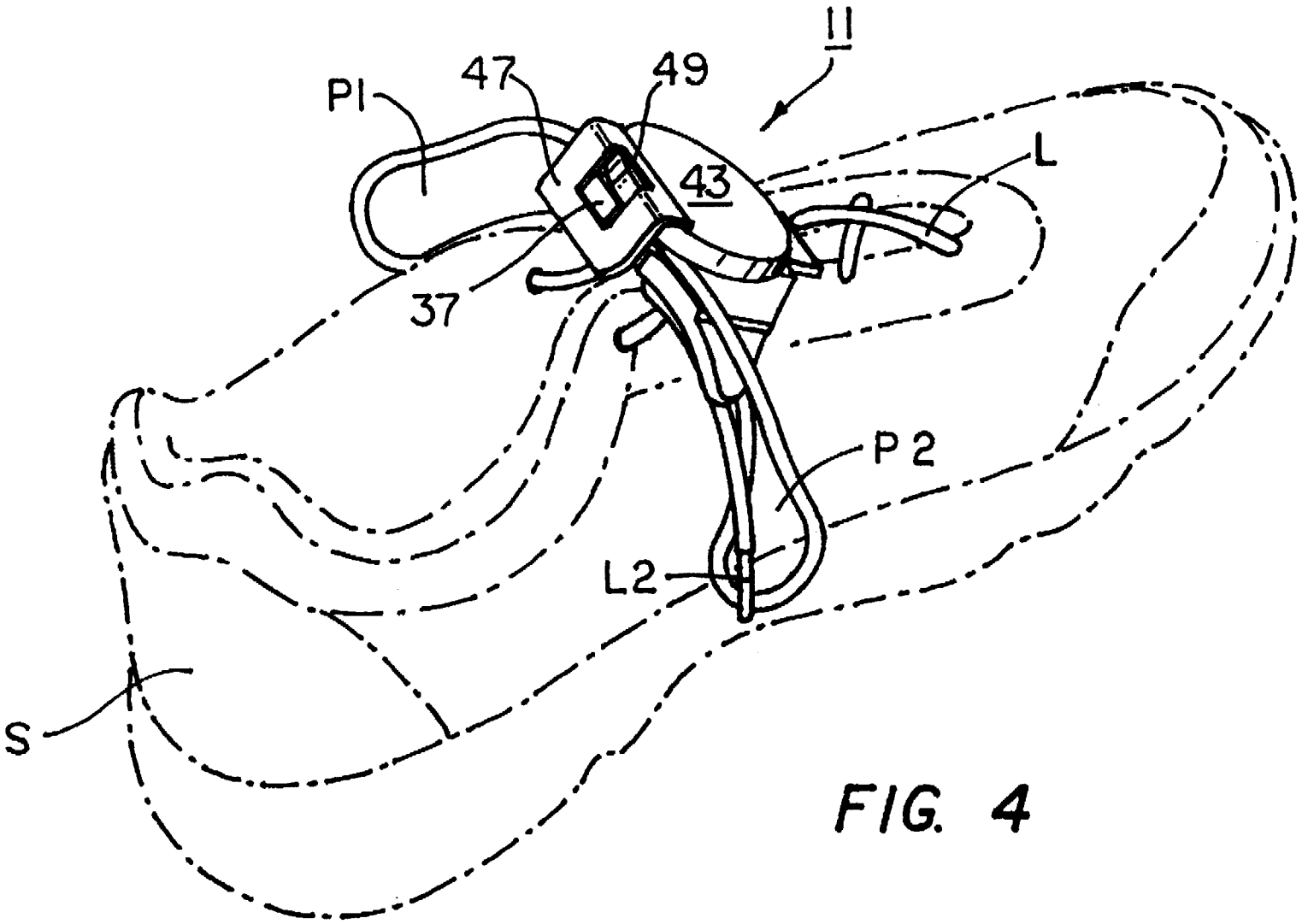
FIG. 4 is a perspective view of the device of FIG. 3, the device being shown in its closed position.

Device 11 comprises a base 13 and a cover 15, cover 15 being hingedly mounted onto base 13 by a hinge 16. Hinge 16 enables cover 15 to pivot relative to base 13 between an open position, as shown in FIGS. 2 and 3, where base 13 and cover 15 form an angle of more than about 0 degrees and preferably about 90 degrees, and a closed position, as shown in FIG. 4 where base 13 and cover 15 are about parallel with one another. Both base 13 and cover 15 are preferably constructed of a rigid plastic material and can be manufactured through conventional molding techniques. It should be noted that base 13 and cover 15 could be alternatively formed as a single integral piece, with the cover pivoting relative the base about a living hinge.

As will hereinafter be described below, when cover 15 is closed and at least a portion of shoelace L is disposed and sandwiched between base 13 and cover 15, device 11 will prevent shoelace L from loosening within shoe S.

Base 13 is a one-piece member which includes a top surface 17, a bottom surface 19 and a central platform 21.

Central platform 21 is a generally rectangular, flat member and includes a front edge 23, a rear edge 25 and a pair of side edges 27 and 29. Central platform 21 has a length of approximately 1.625 inches from front edge 23 to rear edge 25, a width of approximately 1.25 inches from side edge 27 to side edge 29, and a thickness of approximately 0.1875 inches.

Base 13 further includes a pair of side support arms 31 and 33, a front support arm 35 and a rear tip 37.

Side support arms 31 and 33 and front support arm 35 together serve to support and balance base 13 of clamp 11 on top of shoe S when in use, as will be described in detail below. Side support arm 31 is an arcuate member which extends out approximately one inch from side edge 27. Side support arm 31 includes a nearly flat inner portion 31-1 which is approximately 0.1875 inches thick and a downwardly curved outer portion 31-2 which is approximately 0.10 inches thick. Similarly, side support arm 33 is an arcuate member which extends out approximately one inch from side edge 29. Side support arm 33 includes a nearly flat inner portion 33-1 which is approximately 0.1875 inches thick and a downwardly curved outer portion 33-2 which is approximately 0.10 inches thick. Front support arm 35 is a generally rectangular, flat member which extends out approximately 0.5 inches from front edge 23 of platform 21. Front support arm 35 extends out from a rectangularly-shaped recessed portion 39 in platform 21.

Tip 37 is a generally rectangular, flat member which extends out approximately 0.25 inches from rear edge 25 of platform 21. It is the function of tip 37 to assist in releasably locking cover 15 in the closed position, as will be described in detail below.

Recessed portion 39 is located along front edge 25 and serves as the portion of platform 21 to which hinge 16 is attached by screws 40.

Base 13 also includes six holes 41-1 through 41-6, respectively, which are configured to assist in tying the shoelace of a shoe, as will be described further in detail below. Holes 41 extend the entire way through platform 21 from top surface 17 to bottom surface 19. Holes 41 are each approximately 0.156 inches in diameter and are sized and shaped so as to enable shoelace L to be insertable therethrough. However, it should be noted that the diameter of holes 41 could be increased or decreased to accommodate shoelaces of varying diameters.

Cover 15 is a generally disc-shaped member which has a diameter of approximately 1.75 inches and a thickness of 0.219 inches. However, it is to be understood that cover 15 could be constructed in other shapes or sizes. Cover 15 includes a top surface 43 and a bottom surface 45. Cover 15 is pivotally connected to base 13 by a hinge 16 which is connected to cover 15 by screws 40. Hinge 16 enables cover 15 to be pivoted between an open position in which cover 15 is generally perpendicular to base 13 (as shown in FIGS. 2 and 3) and a closed position in which cover 15 is generally parallel to base 13 (as shown in FIG. 4). In the open position, bottom surface 45 of cover 15 is pivoted away from top surface 17 of base 13 and in the closed position, bottom surface 45 of cover 15 pivoted towards base 13 such that bottom surface 45 is nearly in contact with top surface 17 of base 13.

Cover 15 also includes a locking tab 47 which acts in junction with tip 37 of base 13 to releasably lock cover 15 in the closed position. Locking tab 47 is a slightly curved member which has a central, rectangular opening 49. Opening 49 is sized and shaped so that when cover 15 is in the closed position, tip 37 protrudes through opening 49 to lock cover 15 in place. Once in the locked position, in order to pivot cover 15 into the open position, locking tab 47 is flexed slightly outward to prevent tip 37 from engaging tab 47.

Cover 15 further includes a pair of pins 51-1 and 51-2 and a raised member 53 on bottom surface 45 which all act to further prevent shoelace L from loosening within shoe S.

Pins 51-1 and 51-2 protrude out perpendicularly approximately 0.1 inches from bottom surface 45 of cover 15 and are approximately 0.125 inches in diameter. Pins 51-1 and 51-2 are aligned so as to project into holes 41-1 and 41-2, respectively, when cover 15 is in the closed position. As will be described further below, when cover 15 is in the closed position, when shoelace L is inserted through holes 41 and when base 13 is seated on top of and in direct contact with shoe S, pins 51-1 and 51-2 act to wedge the portion of shoelace L in holes 41 to prevent shoelace L from loosening within shoe S.

Raised member 53 is a raised surface made of a material having projections or rippling folds, such as "VELCRO", and is either fixedly mounted on a portion of bottom surface 45 of cover 15 by an adhesive or is integrally formed onto bottom surface 45. When cover 15 is in the closed position, when shoelace L is inserted through holes 41 and when base 13 is seated on top of and in direct contact with shoe S, raised member 53 acts to engage a portion of shoelace L, thereby preventing shoelace L from loosening within shoe S.

In use, device 11 functions in the following manner to tie shoelace L on shoe S. First, cover 15 is pivoted into the open position. Base 13 is then positioned directly above the instep of shoe S, with tip 37 pointing towards the toe of shoe S and with front support arm 35 pointing towards the heel of shoe S.

With base 13 positioned above shoe S, first and second ends L1 and L2 of shoelace L are inserted through holes 41-1 and 41-2, respectively, of platform 21, ends L1 and L2 being inserted in from the side of bottom surface 19 and passing out through the side of top surface 17. First and second ends L1 and L2 are then inserted through holes 41-3 and 41-4, respectively, of platform 21, ends L1 and L2 being inserted in from the side of top surface 17 and passing out through the side of bottom surface 19. First and second ends L1 and L2 are then pulled tightly to ensure that base 13 is sitting securely on top of the instep of shoe S. As shown in FIG. 2, with shoelaces L being inserted through base 13 as instructed above, a portion of shoelace L lies on top surface 17 of base 13 from hole 41-1 to hole 41-3 and a portion of shoelace L lies on top surface 17 of base 13 from hole 41-2 to hole 41-4.

First end L1 of shoelace L is then looped around side support arm 33 and is inserted partially through hole 41-5 of platform 21, end L1 being inserted in from the side of top surface 17 and passing out through the side of bottom surface 19. Similarly, second end L2 of shoelace L is looped around side support arm 31 and is inserted partially through hole 41-6 of platform 21, end L2 being inserted in from the side of top surface 17 and passing out through the side of bottom surface 19. As shown in FIG. 3, ends L1 and L2 are inserted so as to create a pair of loops P1 and P2, respectively, which are sized so that neither loops P1 and P2 nor ends L1 and L2 will come into contact with the surface directly beneath shoe S.

With shoelace L inserted through base 13 in the manner shown in FIG. 3, cover 15 is pivoted down into the closed position sufficiently so that tip 37 protrudes through opening 49 of locking tab 47 to lock cover 15 in the closed position, as shown in FIG. 4. With cover 15 in the closed position, pins 51 and raised member 53, together with the clamping action of cover 15 and base 13, prevent shoelace L from loosening within shoe S. It should be noted that top surface 43 of cover 15 may have a reflective material or an ornamental design which is either formed thereon or which can be easily secured thereto by an adhesive.

In order to then loosen shoelace L within shoe S, locking tab 47 is flexed slightly outward so that cover 15 can be pivoted into the open position. Base 13 is then pulled slightly away from shoe S to loosen shoelace L in shoe S as desired. It should be noted that base 13 may be pulled far enough away from shoe S so as to enable one to be able to put on or take off shoe S but without having to reinsert shoelace L through holes 41.

The embodiments of the present invention described above are intended to be merely exemplary and those skilled in the art shall be able to make numerous variations and modifications to it without departing from the spirit of the present invention. For example, the size or shape of the device may be changed so as to be used with shoes of various sizes and styles. All such variations and modifications are intended to be within the scope of the present invention as defined in the appended claims.

What is claimed is:

1. A device for tying a shoelace on a shoe, the shoelace having a first end and a second end, said device comprising:

a) a base having a top surface and a bottom surface, said base further including first and second holes which are sized and shaped so that the shoelace can be inserted therethrough; and b) a cover having a top surface and a bottom surface, said cover being hingedly mounted on said base so as to be pivotable between an open position and a closed position, said cover further including first and second pins which are aligned so as to project into the first and second holes, respectively, when said cover is in the closed position;

c) wherein with the first and second ends of the shoelace inserted through the first and second holes, respectively, with a portion of the shoelace positioned between said base and said cover, with the base seated on top of and in direct contact with the shoe and with said cover pivoted in the closed position, said device prevents the shoelace from loosening within the shoe, said first and second pins wedging the portion of the shoelace in the first and second holes to prevent the shoelace from loosening within the shoe.

2. The device as claimed in claim 1 wherein said cover can be releasably locked in the closed position.

3. The device as claimed in claim 2 wherein said cover includes a locking tab and said base includes a tip, said locking tab being sized and shaped to engage said tip to releasably lock said cover in the closed position.

4. The device as claimed in claim 3 wherein said base further includes third, fourth, fifth and sixth holes sized and shaped so that the shoelace can be inserted therethrough, such that with the first end of the shoelace inserted through the first, third and fifth holes and the second end of the shoelace inserted through the second, fourth and sixth holes, with the base seated on top of and in direct contact with the shoe and with said cover pivoted in the closed position, said device prevents the shoelace from loosening within the shoe.

5. The device as claimed in claim 4 wherein said base further includes a pair of support arms for supporting said base when seated on top of and in direct contact with the shoe.

6. The device as claimed in claim 5 wherein a portion of the bottom surface of said cover is raised and engages a portion of the shoelace positioned between said base and said cover when said base seated on top of and in direct contact with the shoe and when said cover pivoted in the closed position so as to prevent the shoelace from loosening within the shoe.

7. The device as claimed in claim 6 wherein said device is integrally formed as a single piece.

8. The device as claimed in claim 7 wherein the top surface said cover includes a reflective material.

9. The device as claim in claim 7 wherein the top surface of said cover includes an ornamental design.

* * * * *